US011043347B2

(12) United States Patent
Sunohara et al.

(10) Patent No.: US 11,043,347 B2
(45) Date of Patent: Jun. 22, 2021

(54) ELECTROMAGNETIC RELAY

(71) Applicant: FUJITSU COMPONENT LIMITED, Tokyo (JP)

(72) Inventors: Takaki Sunohara, Tokyo (JP); Nobuyoshi Hiraiwa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 234 days.

(21) Appl. No.: 16/174,872

(22) Filed: Oct. 30, 2018

(65) Prior Publication Data

US 2019/0157030 A1 May 23, 2019

(30) Foreign Application Priority Data

Nov. 22, 2017 (JP) ..... JP2017-224556

(51) Int. Cl.

| | |
|---|---|
| ***H01H 1/00*** | (2006.01) |
| ***H01H 50/56*** | (2006.01) |
| ***H01H 50/64*** | (2006.01) |
| ***H01H 50/54*** | (2006.01) |
| *H01H 51/29* | (2006.01) |
| *H01H 50/04* | (2006.01) |
| *H01H 50/02* | (2006.01) |
| *H01H 50/26* | (2006.01) |
| *H01H 1/26* | (2006.01) |

(52) U.S. Cl.

CPC ..... *H01H 50/56* (2013.01); *H01H 50/54* (2013.01); *H01H 50/646* (2013.01); *H01H 50/02* (2013.01); *H01H 50/04* (2013.01); *H01H 50/26* (2013.01); *H01H 51/29* (2013.01); *H01H 2001/265* (2013.01); *H01H 2203/026* (2013.01); *H01H 2225/002* (2013.01); *H01H 2225/008* (2013.01); *H01H 2225/016* (2013.01); *H01H 2235/018* (2013.01)

(58) Field of Classification Search

CPC ..... H01H 50/56; H01H 50/54; H01H 50/646; H01H 50/02; H01H 50/04; H01H 50/26; H01H 51/29; H01H 2001/265; H01H 2203/026; H01H 2225/002; H01H 2225/008; H01H 2225/016; H01H 2235/018

USPC ..... 335/196

See application file for complete search history.

(56) References Cited

U.S. PATENT DOCUMENTS 4,258,344 A * 3/1981 Nishimi ..... H01H 50/54 335/129
5,359,305 A * 10/1994 Kitamura ..... H01H 50/16 335/78
5,696,475 A * 12/1997 Yoshitani ..... H01H 50/026 335/78

(Continued)

FOREIGN PATENT DOCUMENTS

| | | |
|---|---|---|
| EP | 2365501 | 9/2011 |
| JP | H09-097550 | 4/1997 |

*Primary Examiner* — Shawki S Ismail
*Assistant Examiner* — Lisa N Homza
(74) *Attorney, Agent, or Firm* — IPUSA, PLLC

(57) ABSTRACT

An electromagnetic relay includes a fixed spring, a fixed contact configured to be swaged so as to be attached to the fixed spring, a movable spring, and a movable contact provided on the movable spring so as to be capable of making contact with the fixed contact, wherein a swaged portion of the fixed contact is formed so as not to protrude from a surface of the fixed spring.

2 Claims, 13 Drawing Sheets

(56) References Cited

U.S. PATENT DOCUMENTS

| | | | | |
|---|---|---|---|---|
| 6,486,760 | B2 | 11/2002 | Miyazaki et al. | |
| 6,621,394 | B2 * | 9/2003 | Ono | H01H 50/042 335/159 |
| 7,283,026 | B2 | 10/2007 | Nakamura et al. | |
| 7,477,119 | B2 * | 1/2009 | Wu | H01H 50/043 335/128 |
| 2006/0181376 | A1 * | 8/2006 | Mikl | H01H 50/648 335/78 |
| 2011/0121926 | A1 | 5/2011 | Kojima et al. | |
| 2014/0062626 | A1 * | 3/2014 | Saito | H01H 51/04 335/185 |
| 2015/0325385 | A1 * | 11/2015 | Kinoshita | H01H 50/541 335/189 |
| 2015/0325390 | A1 * | 11/2015 | Kinoshita | H01H 50/58 335/201 |
| 2015/0325398 | A1 * | 11/2015 | Nakahara | H01H 50/642 335/192 |
| 2015/0325399 | A1 * | 11/2015 | Kinoshita | H01H 50/02 335/189 |
| 2016/0155592 | A1 * | 6/2016 | Ito | H01H 50/36 335/187 |
| 2016/0225565 | A1 * | 8/2016 | Sugisawa | H01H 50/56 |
| 2017/0162354 | A1 * | 6/2017 | Kubono | H01H 1/26 |
| 2017/0301497 | A1 * | 10/2017 | Tanaka | H01H 50/18 |

* cited by examiner

ELECTROMAGNETIC RELAY

CROSS-REFERENCE TO RELATED APPLICATIONS

This application is based on and claims priority to Japanese Patent Application No. 2017-224556, filed on Nov. 22, 2017, the entire contents of which are incorporated herein by reference.

BACKGROUND OF THE INVENTION

1. Field of the Invention

The present invention generally relates to an electromagnetic relay.

2. Description of the Related Art

A fixed contact is swaged so as to be attached to a fixed spring of an electromagnetic relay. When the contact is swaged to the fixed spring, the pressed end of the contact protrudes from the surface of the fixed spring.

In the conventional method of swaging a contact, although coupling strength is high, there is a possibility that a portion protruding from the fixed spring may be brought into contact with a molded part such as a bobbin. If the protruding portion contacts with the bobbin, the bobbin may be chipped and the chipped pieces may be interposed between contacts, which may cause conduction failure. Further, if the protruding portion contacts with the bobbin, the bobbin or the fixed spring may be deformed. As a result, assembly dimensions may deviate from design values, resulting in a decrease in a non-adjustment rate and an increase in a failure rate. If a structure for avoiding contact between the protruding portion of the contact and the bobbin is provided, it may decrease the strength of the bobbin or may hinder downsizing of the bobbin*.

RELATED-ART DOCUMENTS

Patent Documents

[Patent Document 1] Japanese Unexamined Patent Application Publication No. 9-97550

SUMMARY OF THE INVENTION

It is a general object of an embodiment of the present invention to provide an electromagnetic relay that can prevent a fixed contact from interfering with other parts.

According to at least one embodiment, an electromagnetic relay includes a fixed spring, a fixed contact configured to be swaged so as to be attached to the fixed spring, a movable spring, and a movable contact provided on the movable spring so as to be capable of making contact with the fixed contact, wherein a swaged portion of the fixed contact is formed so as not to protrude from a surface of the fixed spring.

Other objects and further features of the present invention will be apparent from the following detailed description when read in conjunction with the accompanying drawings.

DESCRIPTION OF THE PREFERRED EMBODIMENTS

Figure 1:
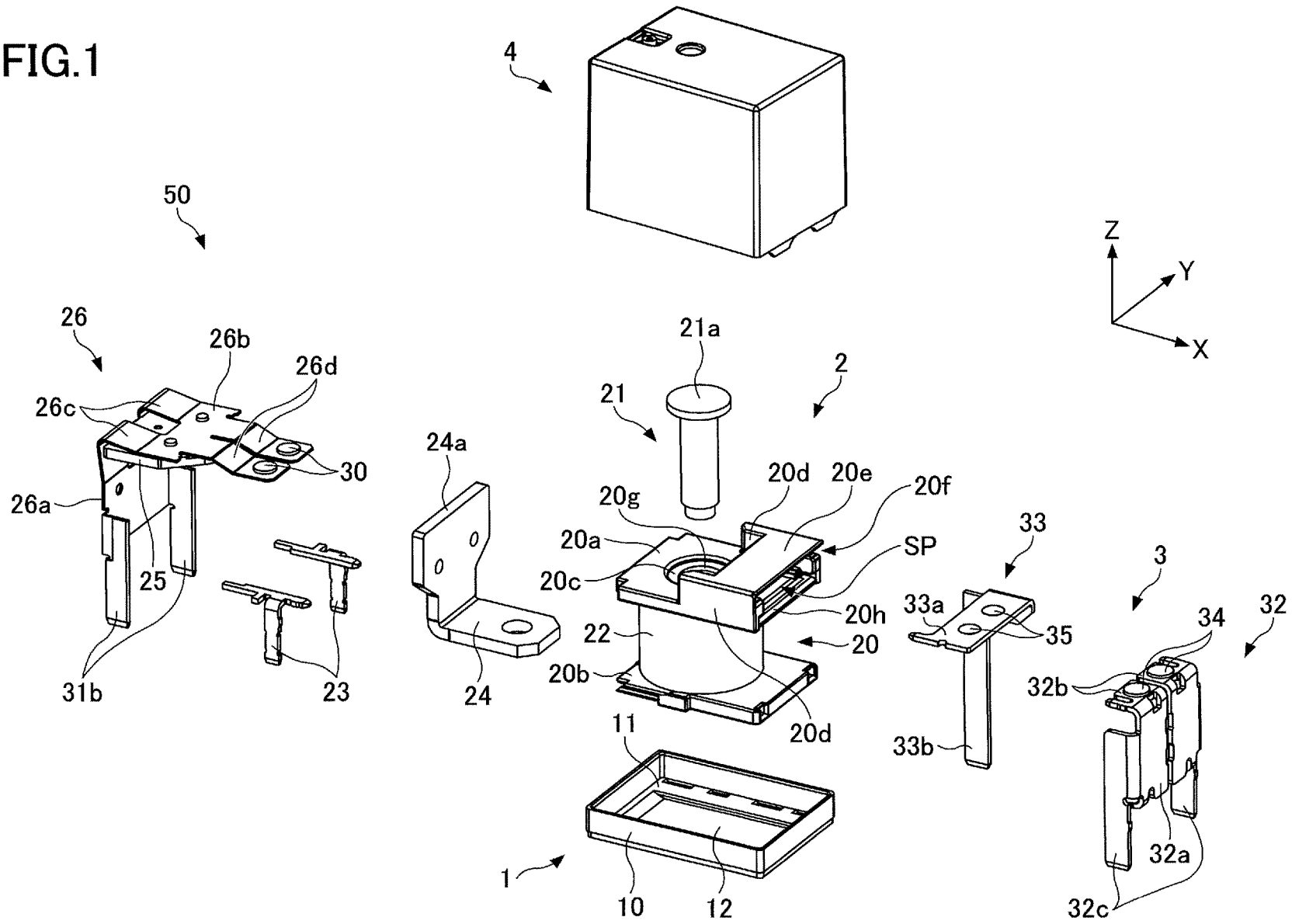
FIG. 1 is an exploded perspective view of an electromagnetic relay according to an embodiment.

According to at least one embodiment, an electromagnetic relay that can prevent a fixed contact from interfering with other parts can be provided.

In the following, embodiments of the present invention will be described with reference to the accompanying drawings. In the drawings, the same elements are denoted by the same reference numerals, and a duplicate description thereof will be omitted.

Figure 2A:
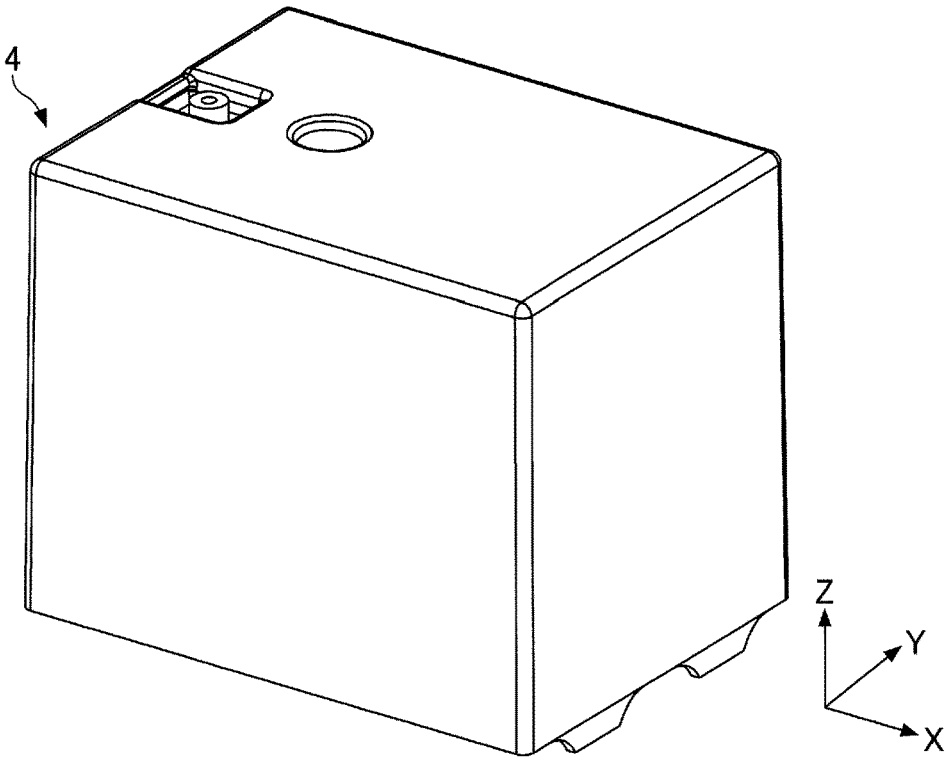
FIGS. 2A and 2B are diagrams illustrating the electromagnetic relay in an assembled state.
Figure 2B:
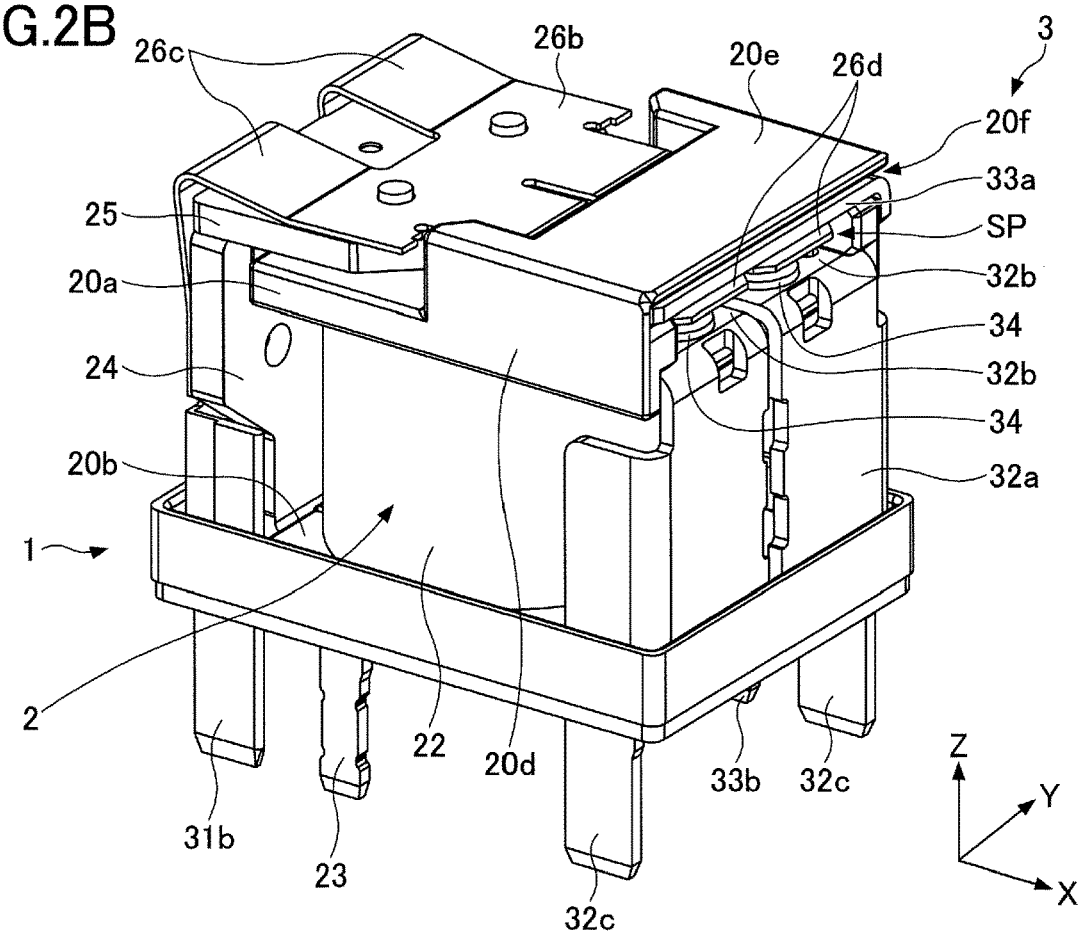

FIG. 1 is an exploded perspective view of an electromagnetic relay 50 according to an embodiment. FIGS. 2A and 2B are diagrams illustrating the electromagnetic relay 50 in an assembled state.

In the following, three axes (x-axis, y-axis, and z-axis) that are perpendicular to each other are used as references to describe shapes and positional relationships of components of the electromagnetic relay 50. As illustrated in FIG. 1, the x-axis is a direction in which components of a contact 3 are fitted to an electromagnet 2. The y-axis is a width direction of the electromagnetic relay 50 and is also a direction in which pairs of terminals 31*b* and terminals 32*c* are arranged. The z-axis is a direction in which the electromagnet 2 and the contact 3 are fitted to a base 1 and a cover 4. A +z direction is taken as upwards and a −z direction is taken as downwards. Also, the x-axis and the y-axis are horizontal directions. A +x side is a side at which a make spring 32 and a break spring 33 are fitted to the electromagnet 2. A −x side is a side at which a movable spring 26 is fitted to the electromagnet 2. A +y side is a side at which a terminal 33*b* of the break spring 33 is disposed. In the following, the +x side may be represented as a front side, the −x side may be represented as a back side, the +y side may be represented as a right side, and the −y side may be represented as a left side.

For example, the electromagnetic relay 50 according to the present embodiment is used for a vehicle in which a 12V DC battery or a 24V DC battery is installed, or is used for a mild hybrid vehicle in which a 48V DC battery is installed. To be more specific, the electromagnetic relay 50 is used for switching control of a control circuit of a 12V DC battery, a 24V DC battery, or a 48V DC battery.

The electromagnetic relay 50 illustrated in FIG. 1 and FIGS. 2A and 2B is a sealed and hinge type relay. The electromagnetic relay 50 includes the electromagnet 2 that is fitted to the base 1, the contact 3 that opens and closes in response to the operation of the electromagnet 2, and the cover 4 that covers the electromagnet 2 and the contact 3. The contact 3 is what is known as a transfer contact, and movable contacts 30 are disposed between fixed contacts 34 and fixed contacts 35. In a state in which an electric current does not flow through the electromagnet 2, the movable contacts 30 contacts with the fixed contacts 35 on the break side (break contacts). In a state in which an electric current flows through the electromagnet 2, the movable contacts 30 contacts with the make fixed contacts 34 on the make side (make contacts).

The base 1 is made of an electrically-insulating resin, and includes a rectangular frame 10 and a bottom 11 that closes the bottom side of the frame 10. The base 1 has a recessed portion 12 that is defined by the frame 10 and the bottom 11 and opens upward. The electromagnet 2 and the contact 3 are fixedly supported by the recessed portion 12. The cover 4 is adhesively fixed to the frame 10.

The electromagnet 2 includes a hollow body 20*g* extending along the z-axis, a spool 20 including an upper flange 20*a* located at the top of the spool 20 and a lower flange 20*b* located at the bottom of the spool 20, an iron core 21 housed in the body 20*g*, and a coil 22 provided on the outer surface of the spool 20. The lower flange 20*b* is fixedly supported by the recessed portion 12.

A stepped portion 20*c* is formed at the center of the upper flange 20*a*. A narrow portion 20*h* having a width narrower than that of the upper flange 20*a* along the y-axis is provided on the front side of the stepped portion 20*c*. Right and left side walls 20*d* is raised upward from the narrow portion 20*h*. Above the front end of the upper flange 20*a*, an upper wall 20*e* parallel to the upper flange 20*a* is provided between two side walls 20*d*. A box-shaped space SP with the front and back sides being open is formed by the upper flange 20*a*, side walls 20*d*, and upper wall 20*e*. At the upper end of the right side wall 20*d*, a slit 20*f* is formed from the front towards the back to be parallel to the upper wall 20*e*. The slit 20*f* is used to mount the break spring 33, which will be described later.

The iron core 21 is a columnar member formed of magnetic steel, for example. An upper end surface 21*a* of the iron core 21 is exposed to the outside from the upper flange 20*a* while the iron core 21 is housed in the spool. The part of the iron core 21 other than the end surface 21*a* is fixedly supported inside the body 20*g*. The wire of the coil 22 is wound around the outer surface of the body 20*g* between the upper flange 20*a* and the lower flange 20*b*. Each end of the coil 22 is connected to corresponding one of coil terminals 23 fixed to the base 1. A yoke 24 is fixedly connected to the lower end of the iron core 21 by, for example, swaging.

The yoke 24 is a plate-shaped member formed by die-cutting and bending a magnetic steel sheet into an L-shape in cross section, for example. In a state in which the electromagnetic relay 50 is assembled, the yoke 24 extends below the lower flange 20*b* along the x-axis and extends behind the body 20*g* along the z-axis. An upper end 24*a* of the yoke 24 is located at approximately the same height as the end surface 21*a*.

An armature 25 is a flat plate-shaped member formed by die-cutting a magnetic steel sheet, for example. In an assembled state as illustrated in FIG. 2B, the armature 25 is disposed above the upper flange 20*a* so as to be approximately parallel to the upper flange 20*a*. At this time, the rear end of the armature 25 contacts with the upper end 24*a* and is supported in a swingable manner. The front bottom surface of the armature 25 is disposed facing the end surface 21*a*. This configuration allows a magnetic circuit to be formed among the iron core 21, the yoke 24, and the armature 25 upon the electromagnet 2 being operated.

The armature 25 is attached to the movable spring 26, and is resiliently and relatively-movably coupled to the yoke 24 via the movable spring 26. The movable spring 26 is formed by die-cutting and bending a thin sheet formed of phosphor bronze for springs into an approximately L-shape. As illustrated in FIG. 1, the movable spring 26 integrally includes a vertical portion 26*a* fixed to the back surface of the yoke 24 by, for example, swaging, a horizontal portion 26*b* fixed to the upper surface of the armature 25 by, for example, swaging, right and left hinge springs 26*c* formed so as to be bent and connecting the vertical portion 26*a* and the horizontal portion 26*b*, and right and left arms 26*d* bifurcated from the horizontal portion 26*b* in the right-left direction and extending frontward.

The movable spring 26 functions as a hinge that elastically connects the yoke 24 and the armature 25, and biases the armature 25 in a direction away from the end surface 21*a* by means of the spring force of the hinge springs 26*c*. The movable contacts 30 are attached to the respective tips of the arms 26*d* by, for example, swaging. The arms 26*d* are inserted into the space SP between the upper wall 20*e* and the upper flange 20*a* from the back side. The movable contacts 30 are disposed in the space SP so as to be capable of making contact with the make contacts 34 and the break contacts 35, which will be described later.

The right and left ends of the vertical portion 26*a* form terminals 31*b* that are bent frontward at approximately a right angle and extend downward. The terminals 31*b* are disposed at the right and left rear corners of the recessed portion 12, and penetrate the bottom 11 of the base 1.

The make spring 32 is formed by die-cutting and bending a copper sheet, for example. As illustrated in FIG. 1, the make spring 32 integrally includes a front plate 32*a* extending in front of the spool 20 in the vertical direction, horizontal portions 32*b* formed by bending the top of the front plate 32*a* backward at approximately a right angle and bifurcated from the top of the front plate 32*a* along the y-axis and extending backward, and right and left terminals 32*c* formed by bending the right and left ends of the front plate 32*a* backward at approximately a right angle and extending below the front plate 32*a*.

The horizontal portions 32*b* are inserted into the space SP from the front side of the spool 20. As illustrated in FIG. 2B, in a state in which the electromagnetic relay 50 is assembled, the horizontal portions 32*b* are positioned below the arms 26*d*. The make contacts 34, disposed facing the respective movable contacts 30, are attached to the horizontal portions 32*b* by, for example, swaging. As illustrated in FIG. 2B, the terminals 32*c* are disposed at the right and left front ends of the recessed portion 12, and penetrate the bottom 11 of the base 1.

The break spring 33 is formed by die-cutting and bending a copper sheet, for example. The break spring 33 integrally includes a horizontal portion 33*a* that extends along the y-axis and the terminal 33*b* that is bent downward from the right end of the horizontal portion 33*a* at approximately a right angle.

In the assembled state as illustrated in FIG. 2B, the horizontal portion 33*a* is inserted into the slit 20*f* from the front side, and is positioned above the arms 26*d*. The two break contacts 35, disposed facing the respective movable contacts 30, are attached to the horizontal portion 33*a* by, for example, swaging.

In the assembled state as illustrated in FIG. 2B, the terminals 32*c*, the coil terminals 23, and the terminals 31*b* are aligned along the x-axis and protrude downward from the base 1. The lower ends of the terminals 32*c*, the coil terminals 23, and the terminals 31*b* are approximately on the same level. Any or all of the terminals 32*c*, the coil terminals 23, and the terminals 31*b* may be integrally formed with the base 1 by, for example, insert molding. The terminals 32*c*, the coil terminals 23, and the terminals 31*b* are dispersed in the front-back and right-left directions of the electromagnetic relay 50. Thus, it is possible to provide a sufficient distance between the terminals while also downsizing the electromagnetic relay 50, making it easy to form a pattern of a circuit on which the electromagnetic relay 50 is mounted.

For example, the electromagnetic relay 50 is operated as follows. When voltage is not applied to the coil 22, the movable spring 26 biases the armature 25 in a direction away from the movable spring 26. Accordingly, the movable contacts 30 are held at a non-operating position away from the make contacts 34 while making contact with the break contacts 35 (see FIG. 7). At this time, contact pairs of the movable contacts 30 and the break contacts 35 are closed, allowing an electric current to flow between the terminals 31*b* and the terminal 33*b* through the contact pairs.

Conversely, when voltage is applied to the coil 22, magnetic attractive force of the electromagnet 2 attracts the armature 25 toward the upper surface 21*a* against the spring force of the movable spring 26, and the movable contacts 30 move downward. Accordingly, the movable contacts 30 make contact with the make contacts 34. Also, the movable contacts 30 are stationarily held at an operating position.

Because contact pairs of the movable contacts 30 and make contacts 34 are provided at the right and left, a parallel circuit is formed between the two contact pairs when the electromagnet 2 is operated. Accordingly, an electric current is branched and flows through each of the two contact pairs.

Figure 3:
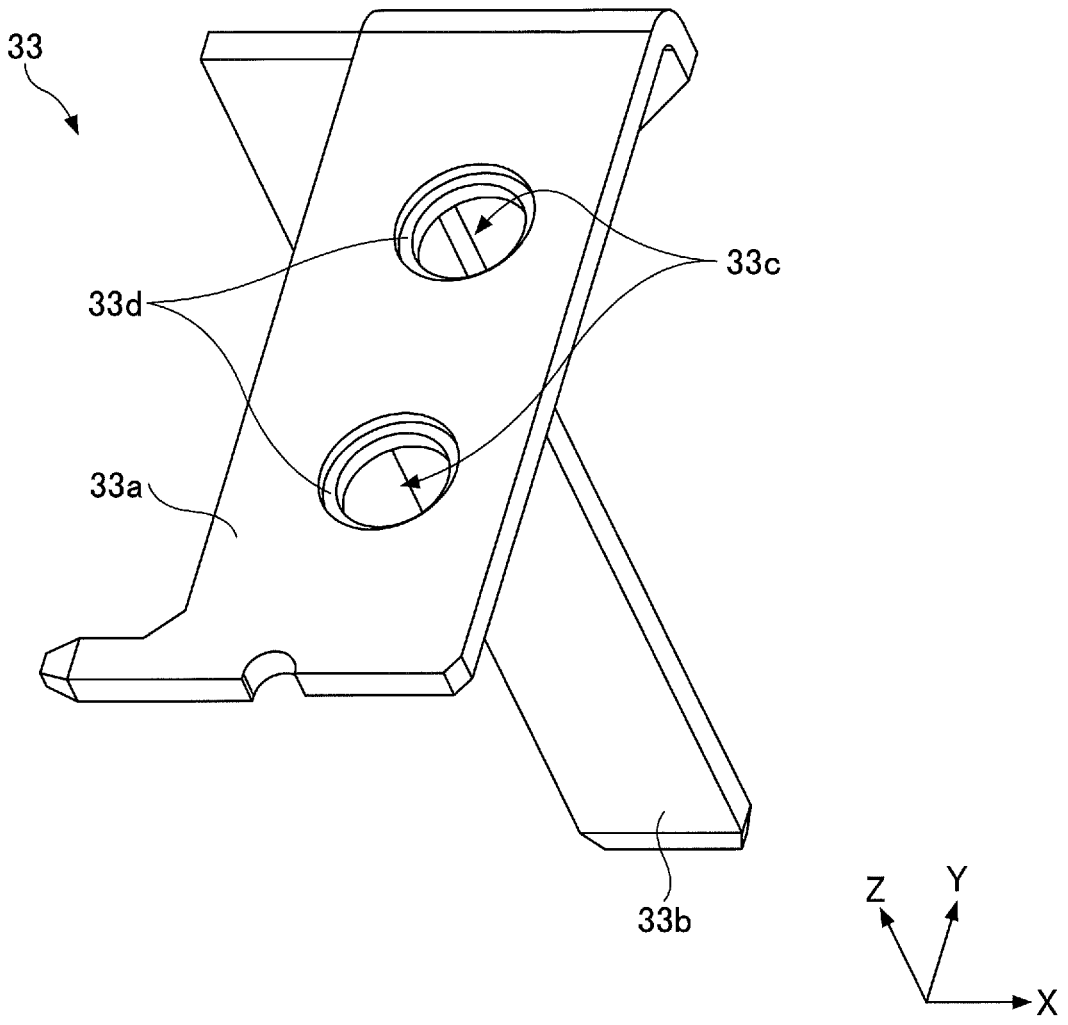
FIG. 3 is a perspective view of a break spring according to the present embodiment.
Figure 4:
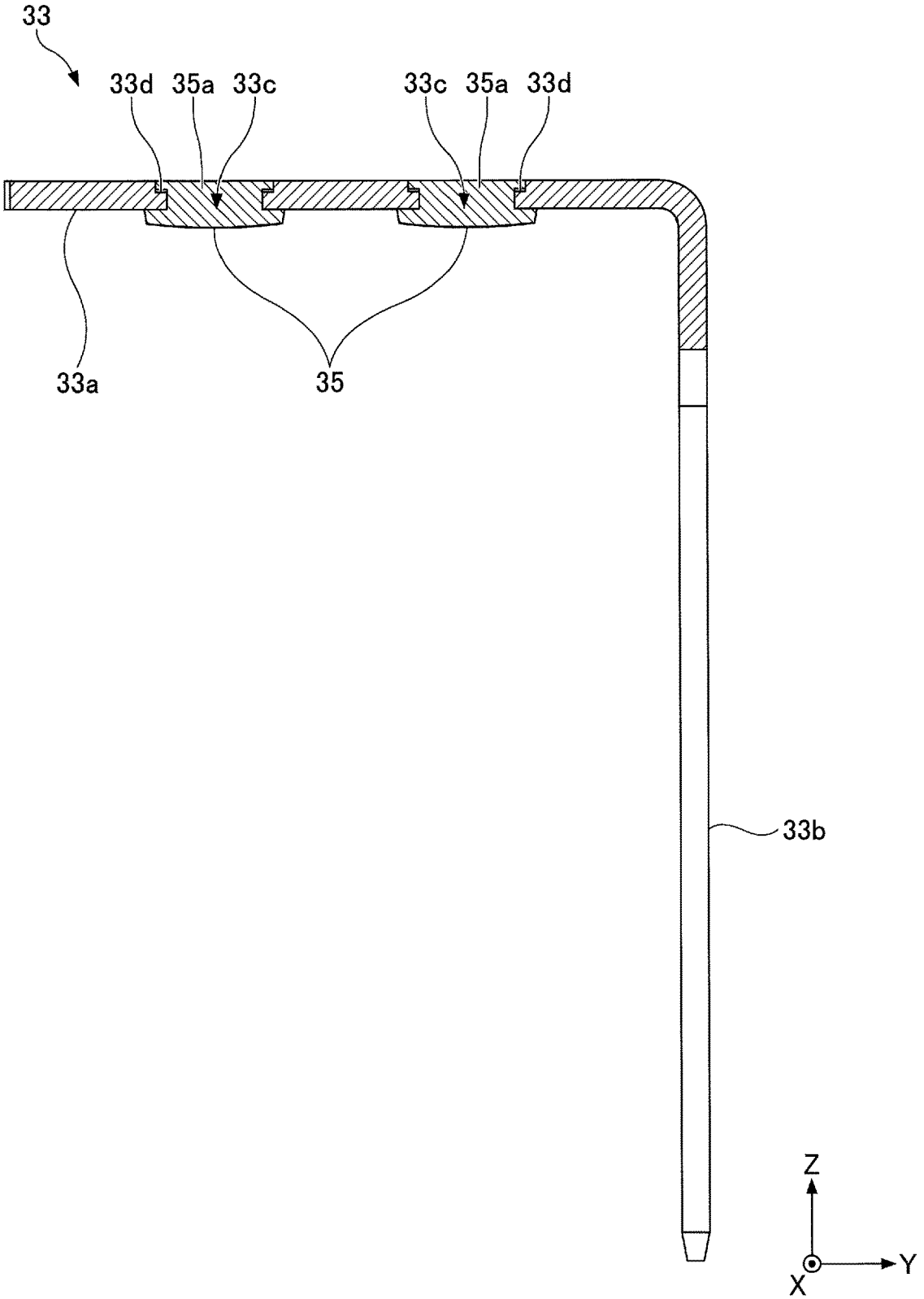
FIG. 4 is a cross-sectional view of the break spring having break contacts being attached.
Figure 5:
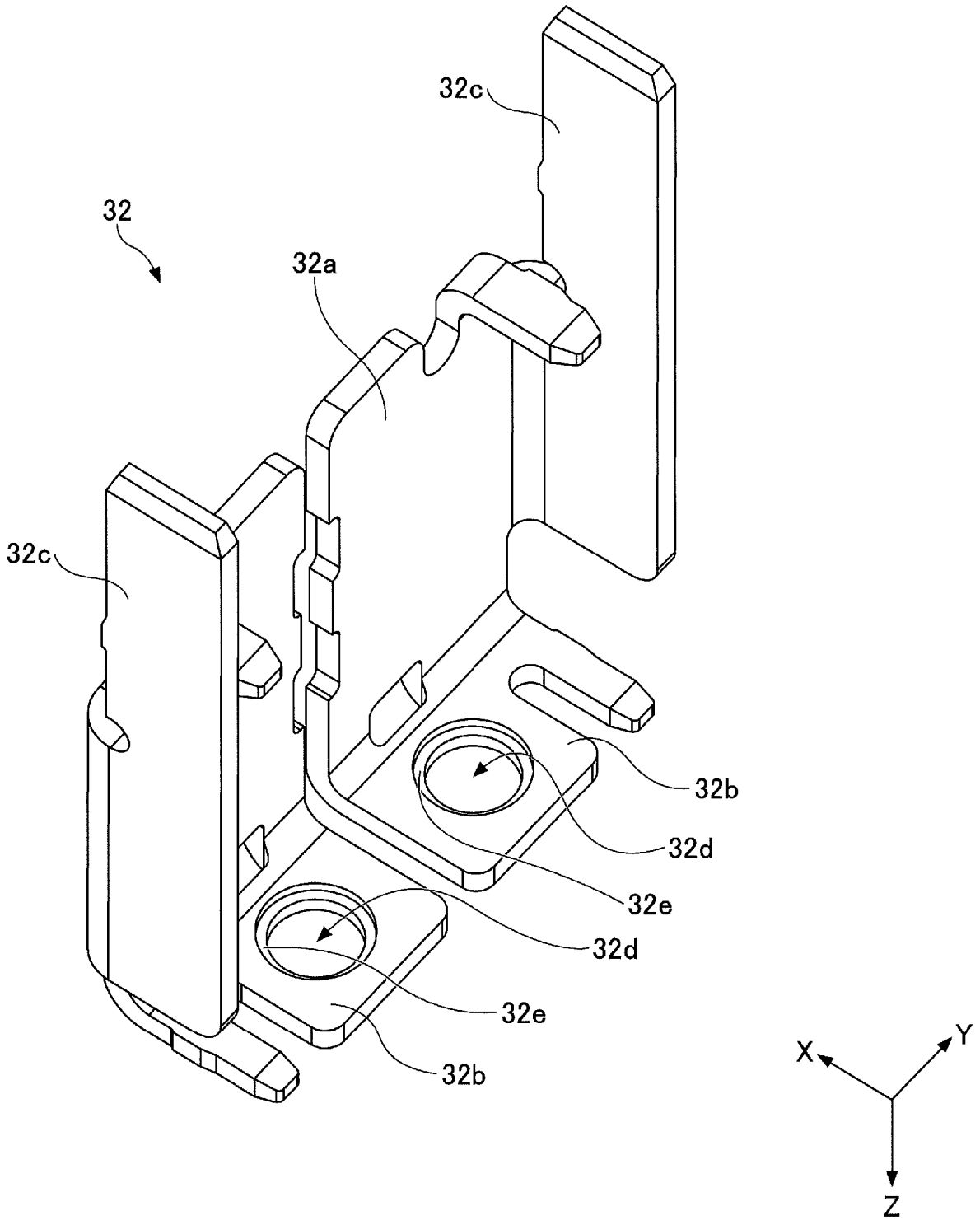
FIG. 5 is a perspective view of a make spring according to the present embodiment.
Figure 6:
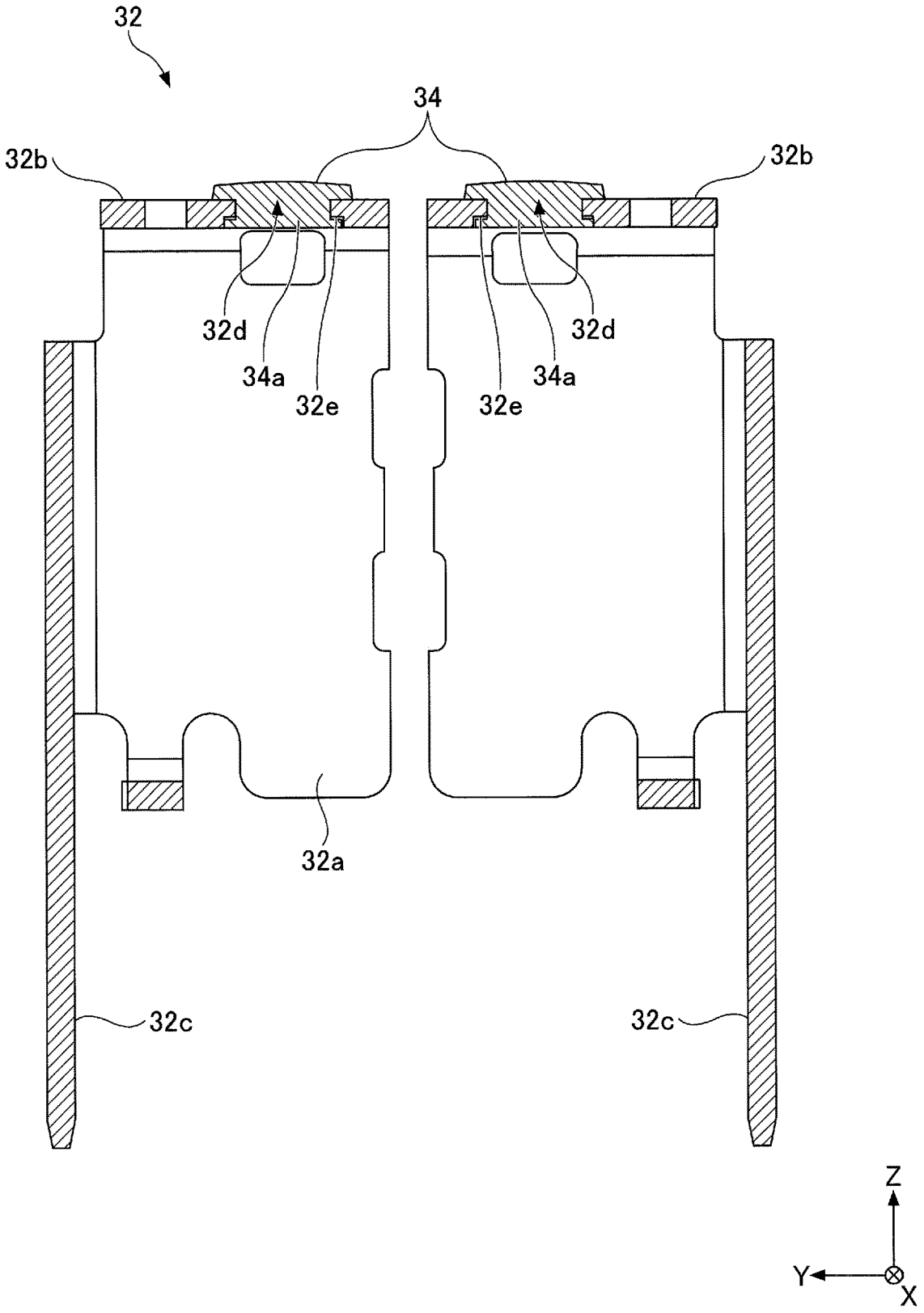
FIG. 6 is a cross-sectional view of the make spring having make contacts being attached.
Figure 7:
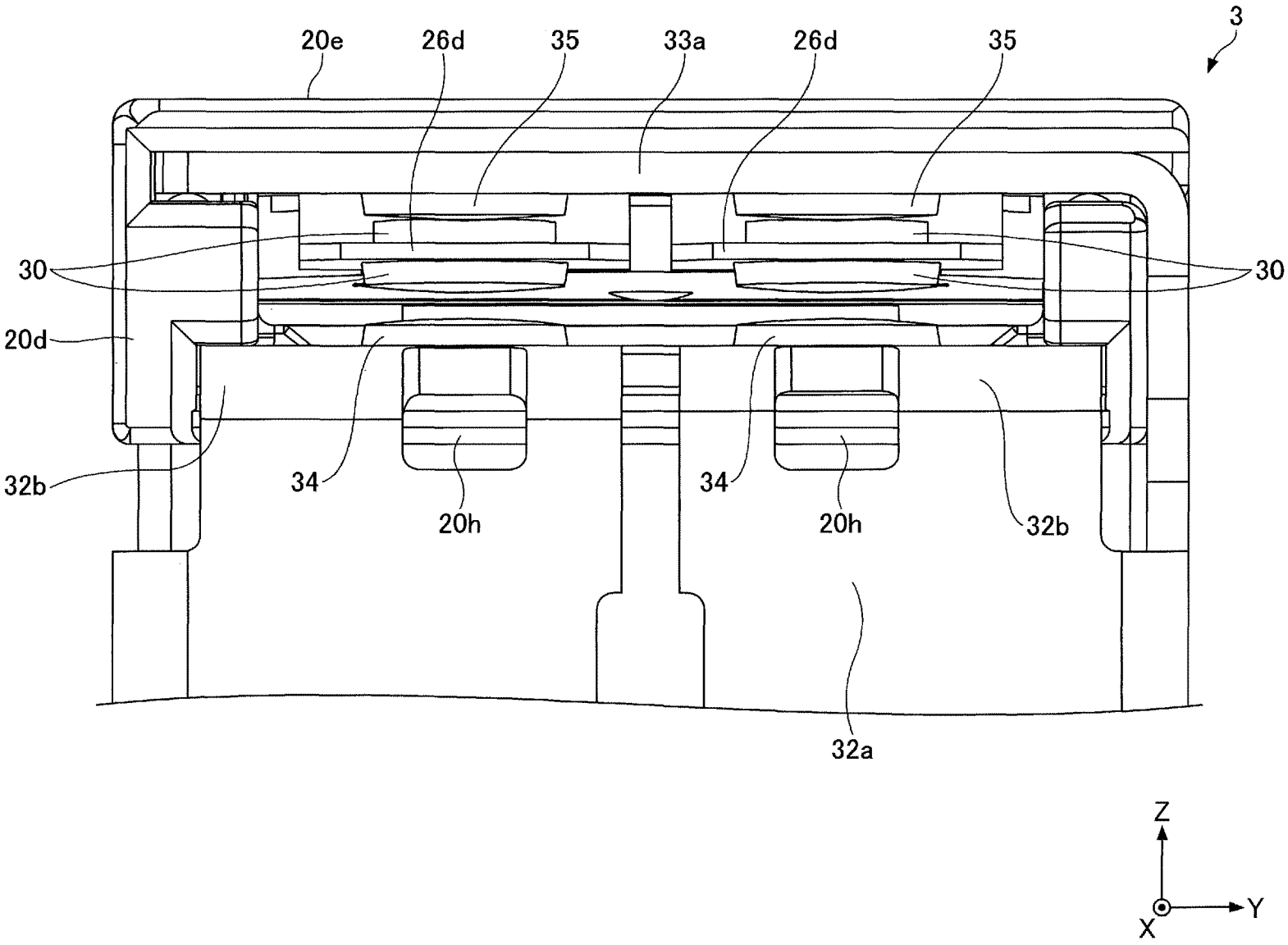
FIG. 7 is a front view of a contact fitted to an electromagnet.
Figure 8:
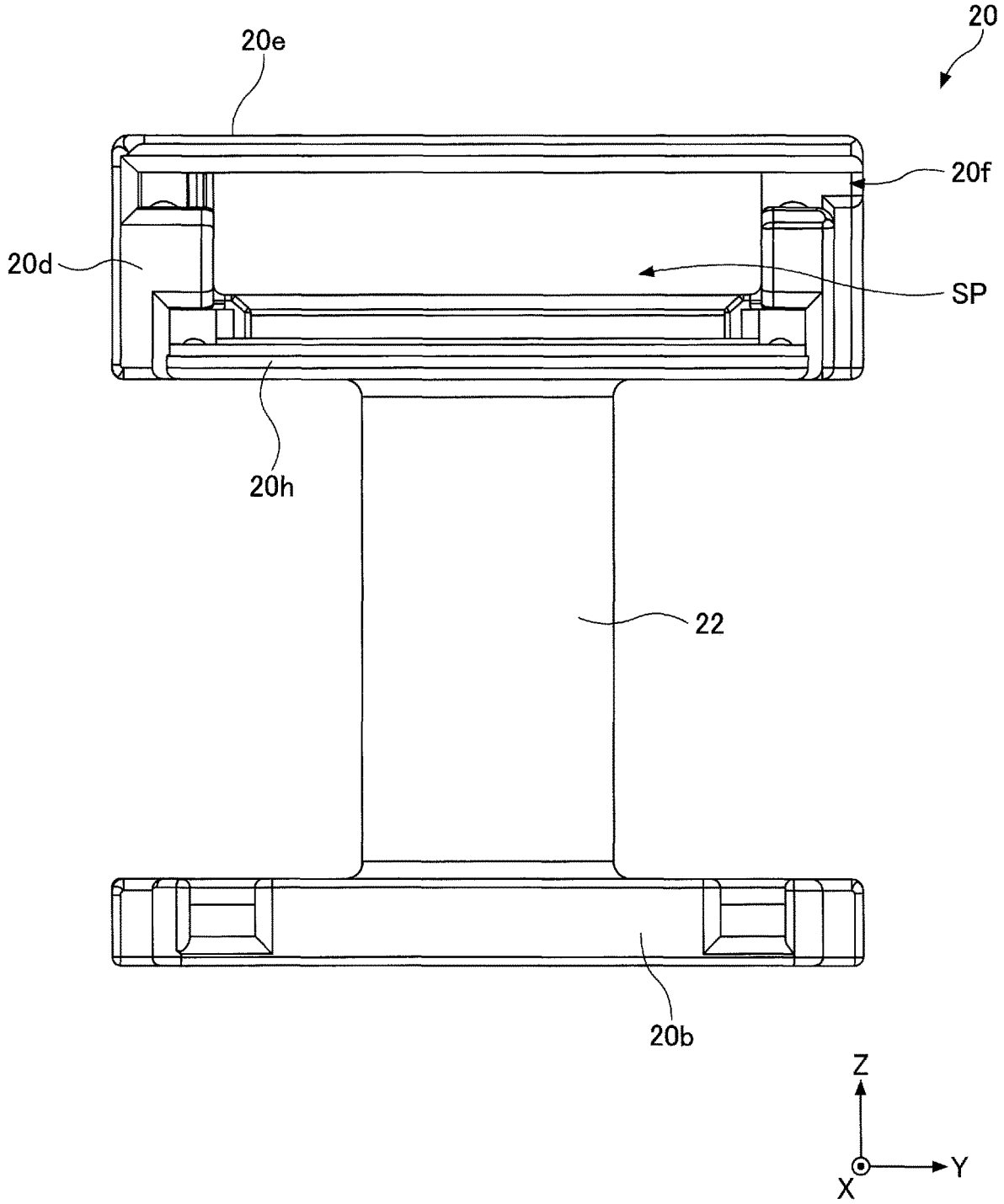
FIG. 8 is a front view of a spool.

Next referring to FIG. 3 through FIG. 8, configurations in which the fixed contacts including the make contacts 34 and the break contacts 35 are attached to the fixed springs including the make spring 32 and the break spring 33, respectively, will be described. FIG. 3 is a perspective view of the break spring 33 according to the present embodiment. FIG. 4 is a cross-sectional view of the break spring 33 having the break contacts 35 being attached. FIG. 5 is a perspective view of the make spring 32 according to the present embodiment. FIG. 6 is a cross-sectional view of the make spring 32 having the make contacts 34 being attached. FIG. 7 is a front view of the contact 3 fitted to the electromagnet 2. FIG. 8 is a front view of the spool 20.

As illustrated in FIG. 3 and FIG. 4, the horizontal portion 33*a* has approximately circular shaped holes 33*c* for attaching the break contacts 35. The break contacts 35 are inserted from below into the holes 33*c* and portions of the break contacts 35 protruding from the horizontal portion 33*a* are swaged. In this way, the break contacts 35 are attached to the break spring 33.

The upper surface of the horizontal portion 33*a*, namely the surface on which the break contacts 35 are swaged, has recesses 33*d* in the holes 33*c*. The recesses 33*d* are each formed in a stepped shape around the entire outer edge of the upper side of the corresponding hole 33*c*. The recesses 33*d* are concentric with the holes 33*c*, and a diameter of the recesses 33*d* is larger than a diameter of the holes 33*c*.

When the break contacts 35 are swaged to the holes 33*c* having the above-described shape, swaged portions 35*a* are each formed so as to extend into the corresponding recess 33*d* as illustrated in FIG. 4. Thus, the swaged portions 35*a* do not protrude from the horizontal portion 33*a*. Accordingly, the upper surface of the horizontal portion 33*a* can be made flat, and also the break contacts 35 can be securely attached to the break spring 33.

As illustrated in FIG. 5 and FIG. 6, the horizontal portions 32*b* have approximately circular shaped holes 32*d* for attaching the make contacts 34. The make contacts 34 are inserted from above into the holes 32*d* and portions of the make contacts 34 protruding from the horizontal portions 32*b* are swaged. In this way, the make contacts 34 are attached to the make spring 32.

The lower surfaces of the horizontal portions 32*b*, namely the surfaces on which the make contacts 34 are swaged, have recesses 32*e* in the holes 32*d*. The recesses 32*e* are each formed in a stepped shape around the entire outer edge of the lower side of the horizontal portions 32*b*. The recesses 32*e* are concentric with the holes 32*d*, and a diameter of the recesses 32*e* is larger than a diameter of the holes 32*d*.

When the make contacts 34 are swaged to the holes 32*d* having the above-described shape, swaged portions 34*a* are each formed so as to extend into the corresponding recess 32*e* as illustrated in FIG. 6. Thus, the swaged portions 34*a* do not protrude from the horizontal portions 32*b*. Accordingly, the lower surfaces of the horizontal portions 32*b* can be made flat, and also the make contacts 34 can be securely attached to the make spring 32.

As described, the swaged portions 35*a* are formed so as not to protrude from the upper surface of the horizontal portion 33*a*. Accordingly, when the contact 3 is fitted to the electromagnet 2, the swaged portions 35*a* do not readily make contact with the lower surface of the upper wall 20*e*. Therefore, as illustrated in FIG. 7 and FIG. 8, the lower surface of the upper wall 20*e* can be made flat, eliminating the need to provide the lower surface of the upper wall 20*e* with a structure for avoiding contact with the swaged portions 35*a* (see FIG. 12).

Similarly, the swaged portions 34*a* are formed so as not to protrude from the lower surfaces of the horizontal portions 32*b*. Accordingly, when the contact 3 is fitted to the electromagnet 2, the swaged portions 34*a* do not readily make contact with the upper surface of the narrow portion 20*h*. Therefore, as illustrated in FIG. 7 and FIG. 8, the upper surface of the narrow portion 20*h* can be made flat, eliminating the need to provide the narrow portion 20*h* with a structure for avoiding contact with the swaged portions 34*a* (see FIG. 12).

By making the upper wall 20*e* and the narrow portion 20*h* flat, the thickness of the upper wall 20*e* and the thickness of the narrow portion 20*h* can be made uniform when the upper wall 20*e* and the narrow portion 20*h* are molded. Accordingly, moldability and strength of the spool 20 can be expected to improve.

Further, the swaged portions 34*a* and 35*a* are formed so as not to protrude from the break spring 33 and the make spring 32, allowing the surfaces of the break spring 33 and the make spring 32 to be made flat. Accordingly, when the fixed springs including the make spring 32 and the break spring 33, whose fixed contacts including the make contacts 34 and the break contacts 35 have been swaged, are press-fitted to the spool 20, the make contacts 34 and the break contacts 35 can be prevented from interfering with the spool 20, and thus, wear and chipping of parts can be reduced. Accordingly, it is possible to prevent a foreign material due to wear and chipping from entering the electromagnetic relay 50, and thus reduce malfunction caused by the foreign material. Also, by preventing the parts from interfering with each other, it is possible to reduce malfunction due to assembly failure. Such malfunction occurs, for example, when the fixed springs are forcibly press-fitted to the spool 20, causing the spool 20 or the fixed springs to be deformed.

It should be noted that, even when the electromagnetic relay 50 has a different internal configuration from that of the present embodiment, namely even when the swaged portions of the make contacts 34 and the break contacts 35 are positioned so as to face parts other than the spool 20, the make contacts 34 and the break contacts 35 can be prevented from interfering with the parts by attaching the make contacts 34 and the break contacts 35 in the same way as the present embodiment. Accordingly, a similar effect to that of the present embodiment can be exhibited.

Also, according to the present embodiment, a stepped recess is formed in a hole such that a portion of a fixed contact extends into the stepped recess and becomes parallel to the surface of a horizontal portion. Thus, coupling strength does not decrease as compared to a method of swaging a fixed contact to a hole without a recess.

Shortening the fixed contact can result in material savings. Also, providing the stepped recess can increase the area of the fixed contact making contact with the fixed spring. Accordingly, it is possible to reduce heat generation and improve strength.

Figure 9:
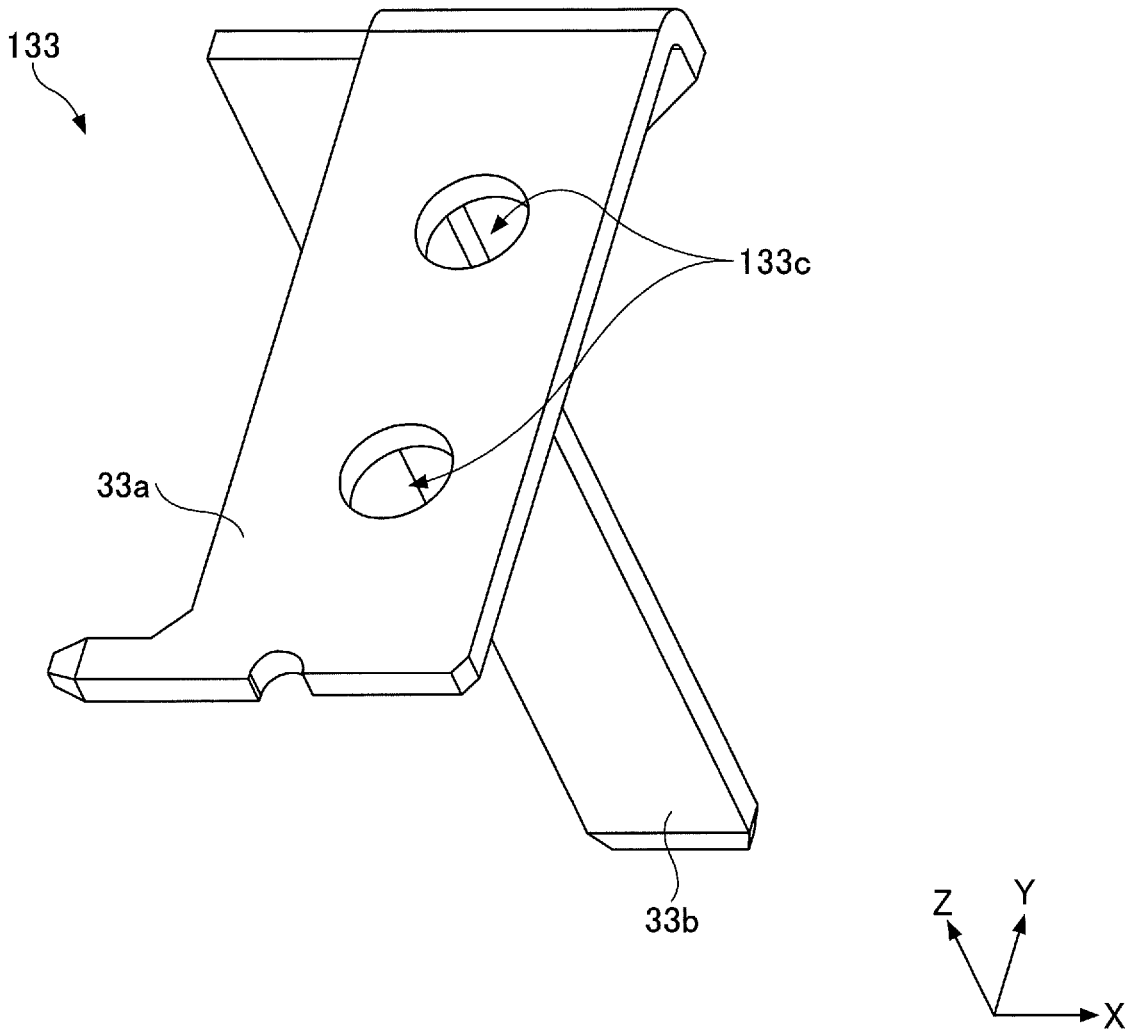
FIG. 9 is a perspective view of a break spring according to a comparative example.
Figure 10:
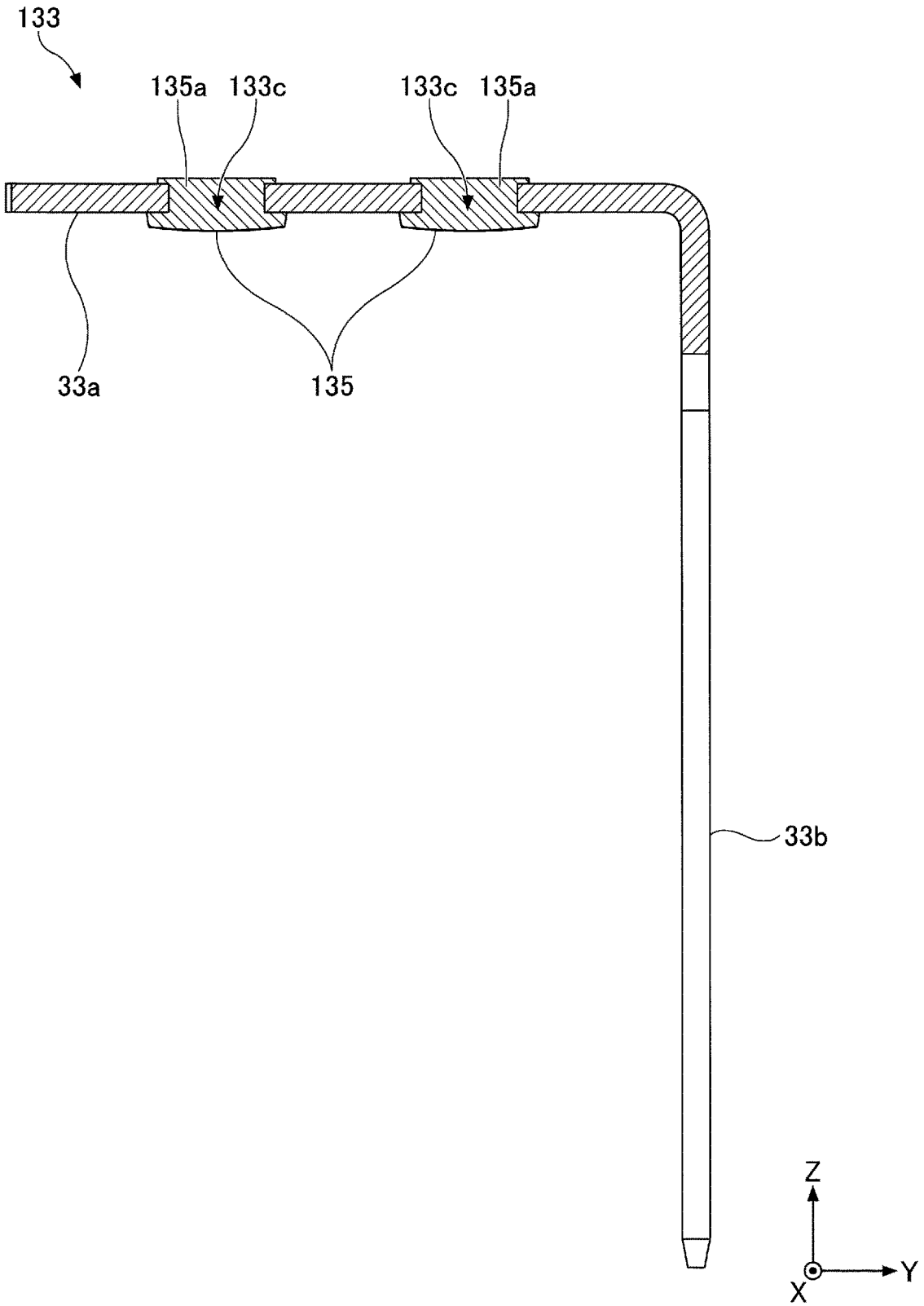
FIG. 10 is a cross-sectional view of the break spring having break contacts being attached.
Figure 11:
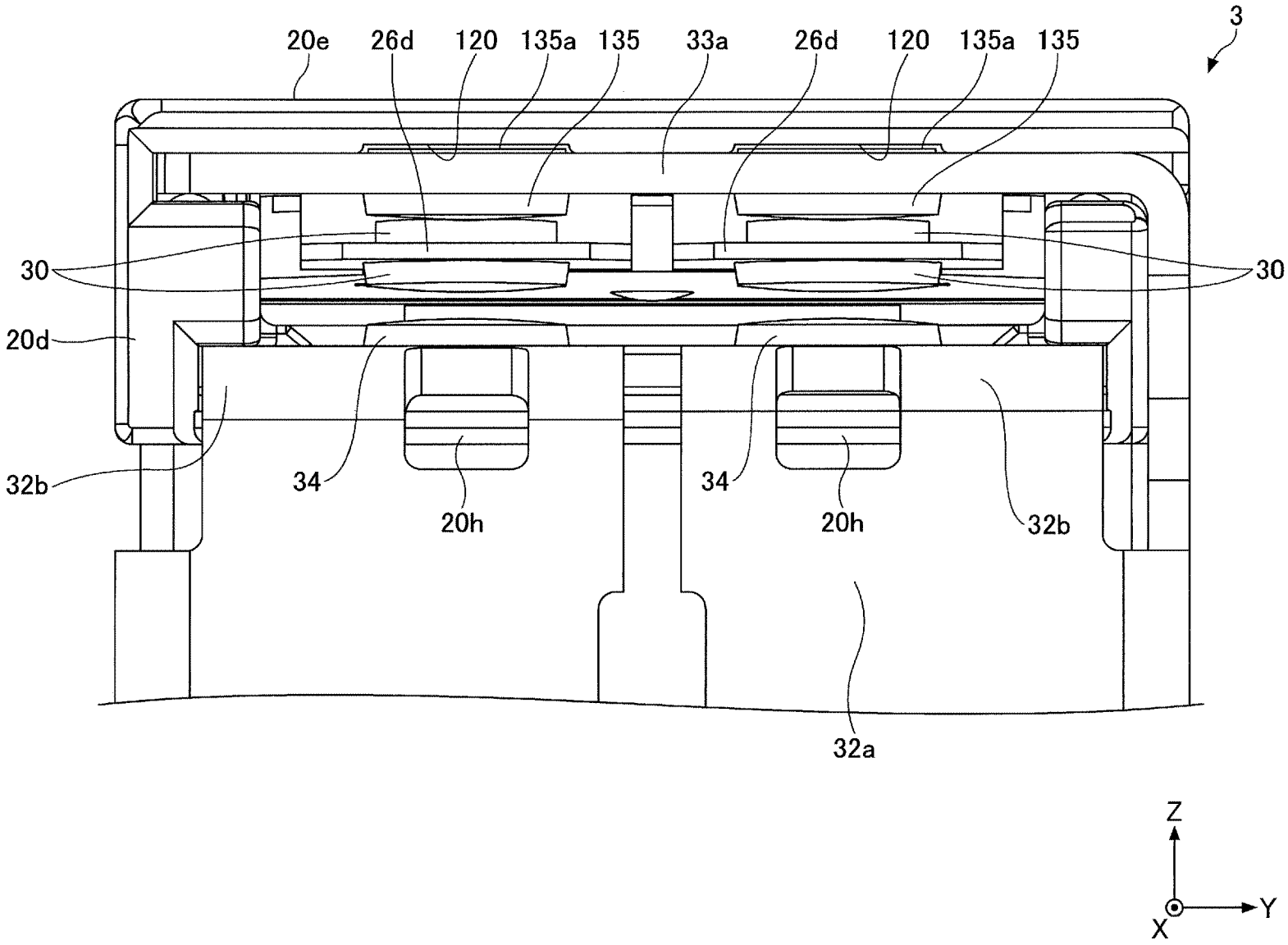
FIG. 11 is a front view of a contact fitted to an electromagnet according to the comparative example.
Figure 12:
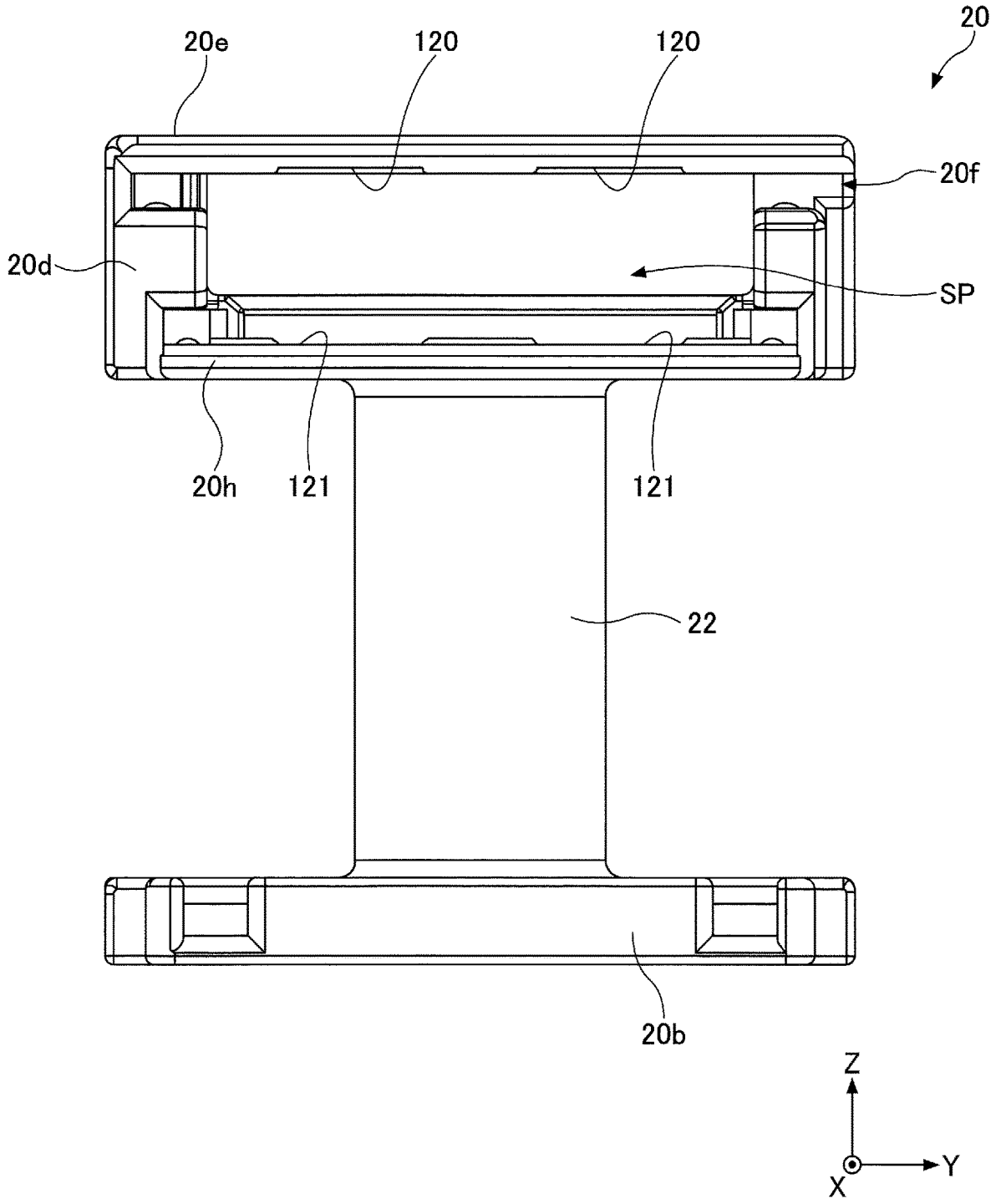
FIG. 12 is a front view of a spool according to the comparative example.

As a comparative example, a hole without a recess will be described below. FIG. 9 is a perspective view of a break spring 133 according to a comparative example. FIG. 10 is a cross-sectional view of the break spring 133 having break contacts 135 being attached. FIG. 11 is a front view of a contact 3 fitted to an electromagnet 2 according to the comparative example. FIG. 12 is a front view of a spool 20 according to the comparative example.

As illustrated in FIG. 9, the break spring 133 does not have recesses in holes 133*c* for attaching the break contacts 135. Thus, when break contacts 135 are swaged and attached, swaged portions 135*a* protrude from the surface of a horizontal portion 33*a* because there are no spaces that allow the swaged portions 135*a* to enter, as illustrated in FIG. 10. Although not illustrated, swaged portions 34*a* also protrude from the surfaces of the horizontal portions 32*b* when recesses are not provided in holes 32*d*.

Figure 13:
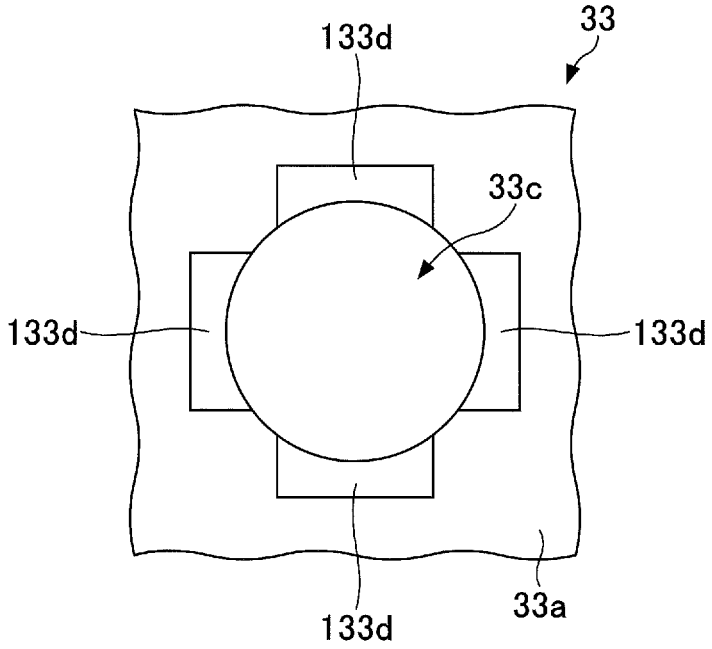
FIG. 13 is a schematic diagram of a recess according to a variation of the embodiment.

In this case, when the contact 3 is fitted to the electromagnet 2, the swaged portions 135*a* tend to make contact with the bottom surface of the upper wall 20*e*. Therefore, the break contacts 135 tend to interfere with the spool 20. As illustrated in FIG. 12 and FIG. 13, the lower surface of the upper wall 20*e* has thus grooves 120 through which the swaged portions 135*a* pass when the break spring 133 is press-fitted to the spool 20.

Similarly, when the contact 3 is fitted to the electromagnet 2, the swaged portions 34*a* tend to make contact with the upper surface of a narrow portion 20. Therefore, the make contacts 34 tend to interfere with the spool 20. As illustrated in FIG. 12, the upper surface of the narrow portion 20*h* has thus grooves 121 through which the swaged portions 34*a* pass when the make spring 32 is press-fitted to the spool 20.

When the spool 20 has the grooves 120 and 121, the thickness of the upper wall 20*e* and the thickness of the narrow portion 20*h* do not become uniform. Thus, moldability and strength of the spool may decrease. Conversely, in the present embodiment, as described with reference to FIG. 8, the surface of the upper wall 20*e* and the surface of the narrow portion 20*h* can be made flat. Accordingly, moldability and strength of the spool 20 can improve.

Referring to FIG. 13, a variation will be described. FIG. 13 is a schematic diagram of a recess according to a variation of the embodiment. Recesses are not limited to those illustrated in FIG. 3 and FIG. 5 and are not necessarily formed around the entire outer edges of the holes 32*d* and 33*c*. The recesses may have any shape as long as the swaged portions 34*a* and 35*a* do not protrude from the surfaces of the fixed springs. For example, as with the case of recesses 133*d* formed in a cross shape illustrated in FIG. 13, the outer edge of the hole 33*c* may be recessed in part.

Further, the recesses may have a tapered shape in cross section. The recesses are not required to be formed in a stepped shape as in the case of the recesses 32*e* and 33*d* illustrated in FIG. 3 and FIG. 5.

Although the embodiments have been specifically described above, the present disclosure is not limited to the above-described embodiments. These specific embodiments may be modified by a person skilled in the art as long as the features of the present disclosure are included. Elements and their arrangement, conditions, and shapes are not limited to the above-described embodiments and may be modified as necessary. It should be noted that combination of the elements of the above-described embodiments may be changed as long as no technical contradiction occurs.

Further, the electromagnetic relay 50 may have internal configurations other than those of the above-described embodiments.

In the above-described embodiments, the number of the movable contacts and of the fixed contacts is 2. However, the number of movable contacts and of the fixed contacts may be 1 or may be 3 or more.

In the above-described embodiments, both the make spring 32 and the break spring 33 have the recesses, such that both the swaged portions 34*a* and 35*a* do not protrude. Alternatively, either one of the make contacts 34 and the break contacts 35 may have recesses. In the electromagnetic relay 50 according to the embodiment illustrated in FIG. 1 and FIG. 2, it is preferable for the break spring 33 to have recesses.

What is claimed is:

1. An electromagnetic relay comprising:

a fixed spring having a hole penetrating therethrough;

a fixed contact inserted into the hole;

a movable spring; and a movable contact provided on the movable spring to make contact with the fixed contact, wherein a first surface of the fixed spring opposite a second surface thereof facing the movable contact has a recess, the recess being formed in a stepped shape around an entire outer edge of the hole penetrating through the fixed spring, and a portion of the fixed contact is swaged to extend in the recess, so that the first surface of the fixed spring with the fixed contact is flat without a protrusion.

2. The electromagnetic relay according to claim 1, wherein a contact of the electromagnetic relay is a transfer contact, the fixed spring includes a make spring and a break spring, the fixed contact includes a make contact provided on the make spring and a break contact provided on the break spring.

* * * * *